US011111725B2

(12) United States Patent
Deolalikar et al.

(10) Patent No.: US 11,111,725 B2
(45) Date of Patent: Sep. 7, 2021

(54) ROTARY STEERABLE SYSTEM WITH ROLLING HOUSING

(71) Applicant: HALLIBURTON ENERGY SERVICES, INC., Houston, TX (US)

(72) Inventors: Neelesh V. Deolalikar, Spring, TX (US); Daniel M. Winslow, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/489,576

(22) PCT Filed: May 15, 2017

(86) PCT No.: PCT/US2017/032758
§ 371 (c)(1),
(2) Date: Aug. 28, 2019

(87) PCT Pub. No.: WO2018/212755
PCT Pub. Date: Nov. 22, 2018

(65) Prior Publication Data

US 2020/0011135 A1 Jan. 9, 2020

(51) Int. Cl.
*E21B 7/06* (2006.01)
*E21B 17/10* (2006.01)
(Continued)

(52) U.S. Cl.
CPC ..... *E21B 7/062* (2013.01); *E21B 7/068* (2013.01); *E21B 17/1014* (2013.01);
(Continued)

(58) Field of Classification Search
CPC ... E21B 7/04; E21B 7/06; E21B 7/062; E21B 7/068; E21B 17/1014; E21B 44/005; E21B 47/024; E21B 47/18
See application file for complete search history.

(56) References Cited

U.S. PATENT DOCUMENTS 4,415,823 A * 11/1983 Jurgens ..... E21B 4/00 310/87
5,484,029 A * 1/1996 Eddison ..... E21B 7/067 175/73

(Continued)

FOREIGN PATENT DOCUMENTS

EP 1008717 A1 6/2000
WO 2017065724 A1 4/2017

OTHER PUBLICATIONS

International Search Report and Written Opinion dated Dec. 14, 2017, of PCT/US2017/032758, filed on May 15, 2017.

*Primary Examiner* — Dany E Akakpo
(74) *Attorney, Agent, or Firm* — Chamberlain Hrdlicka

(57) ABSTRACT

A directional drilling device for drilling a wellbore having a wall, the device including an outer housing, a driveshaft located at least partially within and selectively rotatable with respect to the outer housing. The device also includes extendable members moveable to extend radially outwardly from the outer housing and so as to apply a force onto the wellbore wall and move the device off-center in the wellbore in a direction. The device further includes a hydraulic actuation system operable to control hydraulic fluid to extend and retract of the extendable members. The rotational orientation of the extendable members is controllable by rotation of the outer housing by the driveshaft and the rotational orientation of the extendable members and the outer housing and thus the direction may be maintained by extension of the extendable members into contact with the borehole to restrain the outer housing from rotating.

20 Claims, 6 Drawing Sheets

(51) Int. Cl.
*E21B 44/00* (2006.01)
*E21B 47/024* (2006.01)
*E21B 47/18* (2012.01)

(52) U.S. Cl.
CPC ..... *E21B 44/005* (2013.01); *E21B 47/024* (2013.01); *E21B 47/18* (2013.01)

(56) References Cited

U.S. PATENT DOCUMENTS

| | | | | |
|---|---|---|---|---|
| 6,913,095 | B2 | 7/2005 | Krueger | |
| 7,556,105 | B2 | 7/2009 | Krueger | |
| 2004/0016571 | A1 | 1/2004 | Krueger | |
| 2006/0090935 | A1* | 5/2006 | Van Steenwyk | E21B 7/068 175/73 |
| 2009/0044979 | A1 | 2/2009 | Johnson et al. | |
| 2011/0120725 | A1* | 5/2011 | Downton | E21B 4/06 166/373 |
| 2011/0147089 | A1 | 6/2011 | Kulkarni et al. | |
| 2016/0326804 | A1* | 11/2016 | Gao | E21B 17/1014 |
| 2018/0080283 | A1* | 3/2018 | Wang | E21B 17/1014 |

* cited by examiner

ROTARY STEERABLE SYSTEM WITH ROLLING HOUSING

BACKGROUND

Directional drilling is commonly used to drill non-vertical wellbores. For example, a directional drilling operation may be conducted when the target pay zone cannot be reached from a land site vertically above it. Many directional drilling systems and techniques are based on rotary steerable systems, which allow the drill string to rotate while changing the direction of the borehole. Examples of rotary steerable systems include point-the-bit rotary steerable drilling systems and push-the-bit rotary steerable drilling systems. In point-the-bit systems, the drilling direction is changed by tilting the angle of the drill bit and in push-the-bit systems, the drilling direction is changed by offsetting the drill bit from the center of the wellbore. The tilt angle of the bit is often referred to as the toolface angle, or "toolface."

BRIEF DESCRIPTION OF THE DRAWINGS

For a detailed description of the embodiments of the invention, reference will now be made to the accompanying drawings in which.

DETAILED DESCRIPTION

The present disclosure provides methods and systems for directional drilling. Specifically, the present disclosure provides a directional drilling system, such as a rotary steerable system (RSS) in which drilling direction can be controlled by controlling the position and rotation of the housing of an RSS tool.

Figure 1:
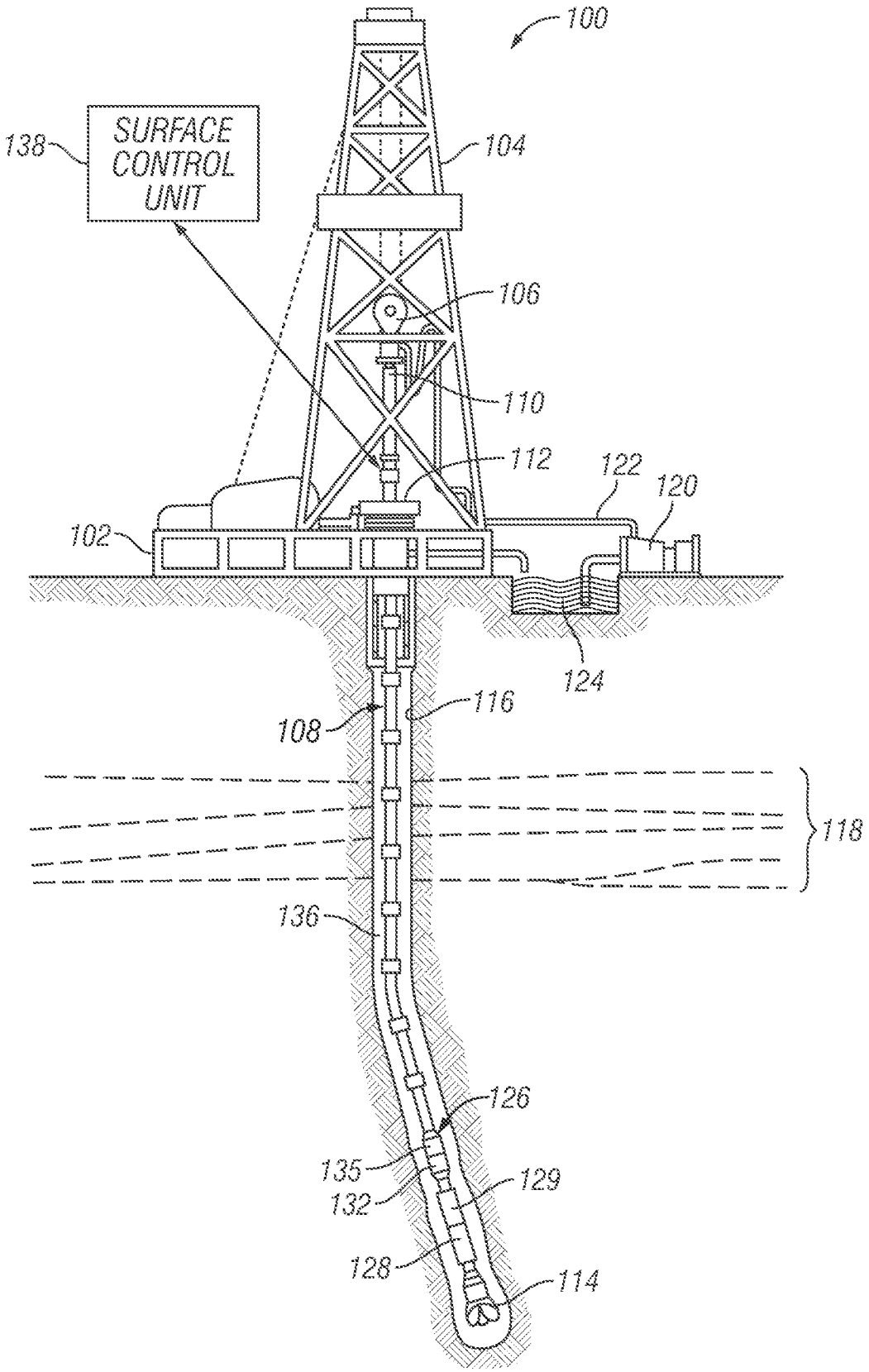
FIG. 1 depicts a schematic view of a directional drilling operation, in accordance with one or more embodiments.

Turning now to the figures, FIG. 1 depicts a schematic view of a drilling operation utilizing a directional drilling system 100, in accordance with one or more embodiments. The system of the present disclosure will be specifically described below such that the system is used to direct a drill bit in drilling a wellbore, such as a subsea well or a land well. Further, it will be understood that the present disclosure is not limited to only drilling an oil well. The present disclosure also encompasses natural gas wellbores, other hydrocarbon wellbores, or wellbores in general. Further, the present disclosure may be used for the exploration and formation of geothermal wellbores intended to provide a source of heat energy instead of hydrocarbons.

Accordingly, FIG. 1 shows a tool string 126 disposed in a directional borehole 116. The tool string 126 includes a rotary steerable tool 128 that provides full 3D directional control of the drill bit 114. A drilling platform 102 supports a derrick 104 having a traveling block 106 for raising and lowering a drill string 108. A kelly 110 supports the drill string 108 as the drill string 108 is lowered through a rotary table 112. Alternatively, a top drive can be used to rotate the drill string 108 in place of the kelly 110 and the rotary table 112. A drill bit 114 is positioned at the downhole end of the tool string 126 and may be driven by a downhole motor 129 positioned on the tool string 126 and/or by rotation of the entire drill string 108 from the surface. As the bit 114 rotates, the bit 114 forms the borehole 116 that passes through various formations 118. A pump 120 circulates drilling fluid through a feed pipe 122 and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116. The drilling fluid may also drive the downhole motor 129.

The tool string 126 may include one or more logging while drilling (LWD) or measurement-while-drilling (MWD) tools 132 that collect measurements relating to various borehole and formation properties as well as the position of the bit 114 and various other drilling conditions as the bit 114 extends the borehole 108 through the formations 118. The LWD/MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 135. The telemetry module 135 receives data provided by the various sensors of the tool string 126 (e.g., sensors of the LWD/MWD tool 132), and transmits the data to a surface unit 138. Data may also be provided by the surface unit 138, received by the telemetry module 135, and transmitted to the tools (e.g., LWD/MWD tool 132, rotary steering tool 128, etc.) of the tool string 126. Mud pulse telemetry, wired drill pipe, acoustic telemetry, or other telemetry technologies known in the art may be used to provide communication between the surface control unit 138 and the telemetry module 135. The surface unit 138 may also communicate directly with the LWD/MWD tool 132 and/or the rotary steering tool 128. The surface unit 138 may be a computer stationed at the well site, a portable electronic device, a remote computer, or distributed between multiple locations and devices. The unit 138 may also be a control unit that controls functions of the equipment of the tool string 126.

The rotary steerable tool 128 is configured to change the direction of the tool string 126 and/or the drill bit 114, such as based on information indicative of tool 128 orientation and a desired drilling direction. The rotary steerable tool 128 is coupled to the drill bit 114 and controls the direction of the drill bit 114. The rotary steerable tool 128 may be either a point-the-bit system or a push-the-bit system.

Figure 2:
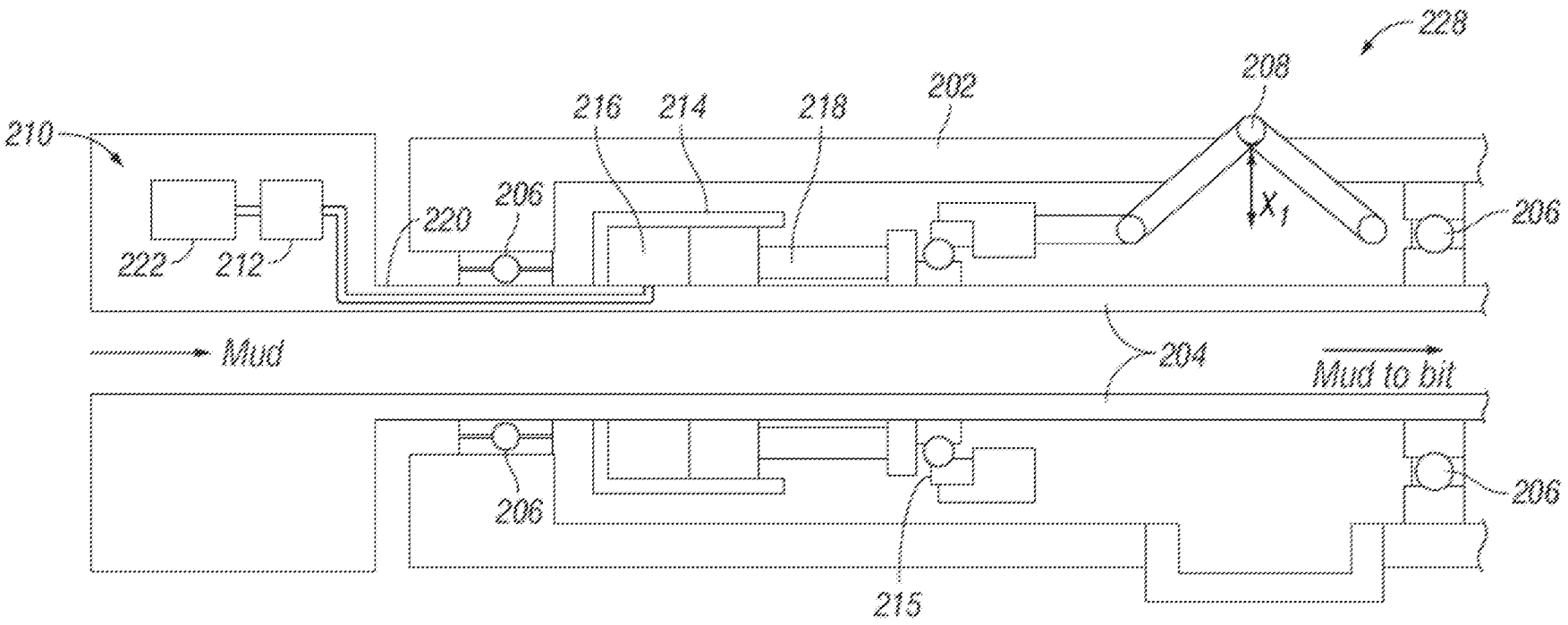
FIG. 2 depicts a cross-sectional schematic view of a rotary steerable tool, according to an example embodiment.

FIG. 2 depicts a cross-sectional schematic view of a rotary steerable tool 228, according to one or more embodiments. The tool 228 includes an outer housing 202 and a driveshaft 204 located at least partially within the outer housing 202 and supported by bearings 206 located between the driveshaft and the outer housing 202 for rotation of the driveshaft 204 with respect to the outer housing 202. The bearings 206 may be any type of bearing that facilitates relative motion between the outer housing 202 and the driveshaft 204. The bearings 206 provide a certain amount of friction between the driveshaft 204 and the outer housing 202 such that the driveshaft 204 applies a torque on the outer housing 202 during rotation, rotating the outer housing 202 with the driveshaft 204. Alternatively, seals or a locking device such as splines, detents, and the like, may be used to couple the driveshaft 204 with the housing 202.

Rotation of the driveshaft 204 may be driven by the downhole motor 129 as shown in FIG. 1, such as a mud motor, or by a top drive from the surface. The tool 228 further includes one or more extendable members 208 spaced around and extendable outwardly from the outer housing 202 and moveable with the outer housing 202. As shown, each extendable member 208 includes a lever arm, which converts linear motion into an orthogonal outward extension. The extendable members 208 may optionally include a traction member that facilitates stationary contact and friction between the extendable members 208 and the wellbore wall. The traction member may include a pad, a textured surface, or any other gripping element(s). The extendable members 208 may be designed so as not to be extendable outwardly the same amount.

The rotary steerable tool 228 further includes a hydraulic actuation system 210 that controls extension and retraction of the extendable members 208. The hydraulic actuation system 210 includes a hydraulic power source 212, e.g., a hydraulic pump, and a piston device 214 mechanically coupled to the extendable members 208. The piston device 214 is hydraulically coupled to the hydraulic pump and extends the extendable members 208 upon an increase in hydraulic pressure. Likewise, the piston device 214 allows the extendable members 208 to retract upon a decrease in hydraulic pressure. Optionally, the outer housing 202 may also include one or more stationary pads (not shown in FIG. 2 but see FIG. 3) that are not extendable or retractable.

The piston device 214 includes a chamber 216 and a piston arm 218. The chamber 216 is hydraulically coupled to the hydraulic pump 212 via a hydraulic channel 220 through the driveshaft 204. The hydraulic pump 212 may also be located in a portion of the driveshaft 204. The piston device 214 may be located between the outer housing 202 and the driveshaft 204. The hydraulic actuation system 210 includes an electric motor 222 configured to drive the hydraulic pump 212. The electronic motor 222 may also be located in the driveshaft 204. Power for the electric motor 222 may be supplied by a power supply, such as a battery, not shown. The hydraulic pump 212 may be operated to create a pressure differential that produces a force on the piston arm 218. The force moves the piston arm 218 axially, producing a force on the extendable members 208 to selectively outwardly extend the extendable members 208.

The more power supplied to the electric motor 222, the larger the pressure applied on the piston arm 218, resulting in more force applied to extend the extendable members 208. Reducing the power supplied to the electric motor 222, by the same principle, results in reducing the force applied to extend the extendable members 208.

When the tool 228 is downhole, outwardly extending the extendable members 208 may initiate or increase the force applied onto the wellbore wall by the extendable members 208, and retracting the extendable members 208 may decrease or remove the force applied onto the wellbore wall by the extendable members 208. Further, the extendable members 208 may be coupled to the piston device 214 via a thrust bearing 215 that allows the extendable members 208 to rotate relative to the piston arm 218 and thus the drive shaft 204.

During a drilling operation, when the extendable members 208 are retracted and not holding the outer housing 202 stationary with respect to the wellbore. Because of the friction between the drive shaft 204 and the outer housing 202, the outer housing 202 rotates in the same direction as the driveshaft 204. Optionally, the outer housing 202 can also be selectively coupled or locked with the driveshaft 204 to rotate the outer housing 202 with the driveshaft.

Certain or all of the extendable members 208 may at times be extended to make contact with the wellbore wall. When one or more of the extendable members 208 are pushed onto the wellbore wall with sufficient force, the extendable members 208 restrain the outer housing 202 from rotating with the driveshaft 204. Thus, the outer housing 202 remains stationary while the driveshaft 204 rotates. Furthermore, as not all of the extendable members 208 may extend or extend the same amount. Also, not all of the pads may be extendable at all. Different configurations may be used such that, when the extendable members 208 push against the wellbore wall, the tool 228 and drill bit 114 are pushed off-center, causing deviation of the wellbore. Thus, a directional well can be formed. The extendable members 208 can be extended and retracted at regular or irregular intervals to control the direction and degree of well segments.

A method of drilling a directional wellbore using the tool 228 includes rotating the driveshaft 204 coupled to the drill bit 114 and at least partially located within the outer housing 202 via bearings 206 located between the driveshaft 204 and the outer housing 202. The driveshaft 204 may be rotated by a downhole motor 129 or by a top drive located at the surface. The method further includes outwardly extending one or more of the extendable members 208, which may include traction members, from the outer housing 202. The extendable members 208 are extended such that one or more extendable members 208 contacts the wellbore wall, which pushes the drill bit off-center from the wellbore, deviating the wellbore, and restrains the outer housing 202 from rotating relative to the borehole wall. Thus, an off-center direction is maintained while the driveshaft 204 rotates the drill bit 114. Extending the extendable members 208 includes applying a hydraulic pressure to the piston device 214 from the hydraulic pump 212. The method also includes decreasing the output of the hydraulic pump 212, thus allowing the extendable members 208 to retract away from the wellbore wall and causing the outer housing 202 to again rotate with the driveshaft. Thus, a particular well can be drilled by controlling extension and retraction of the extendable members 208 to control the direction of the well.

In order to form a straight well section, the extendable members 208 may be extended and retracted at regular intervals such that the extendable members 208 are selectively pushed against the wellbore at various angles, constantly deviating the wellbore evenly in radially symmetric directions, forming a generally straight section overall. A straight wellbore may also be achieved by reducing the pressure on the piston device 214, thus reducing the contact force of the extendable members 208 against the wellbore wall. This causes a continuous rotation of the housing, forming a generally straight well section. The extendable members 208 may also be completely retracted, causing the housing 202 to rotate freely with the driveshaft 204, forming a straight well section.

Figure 3:
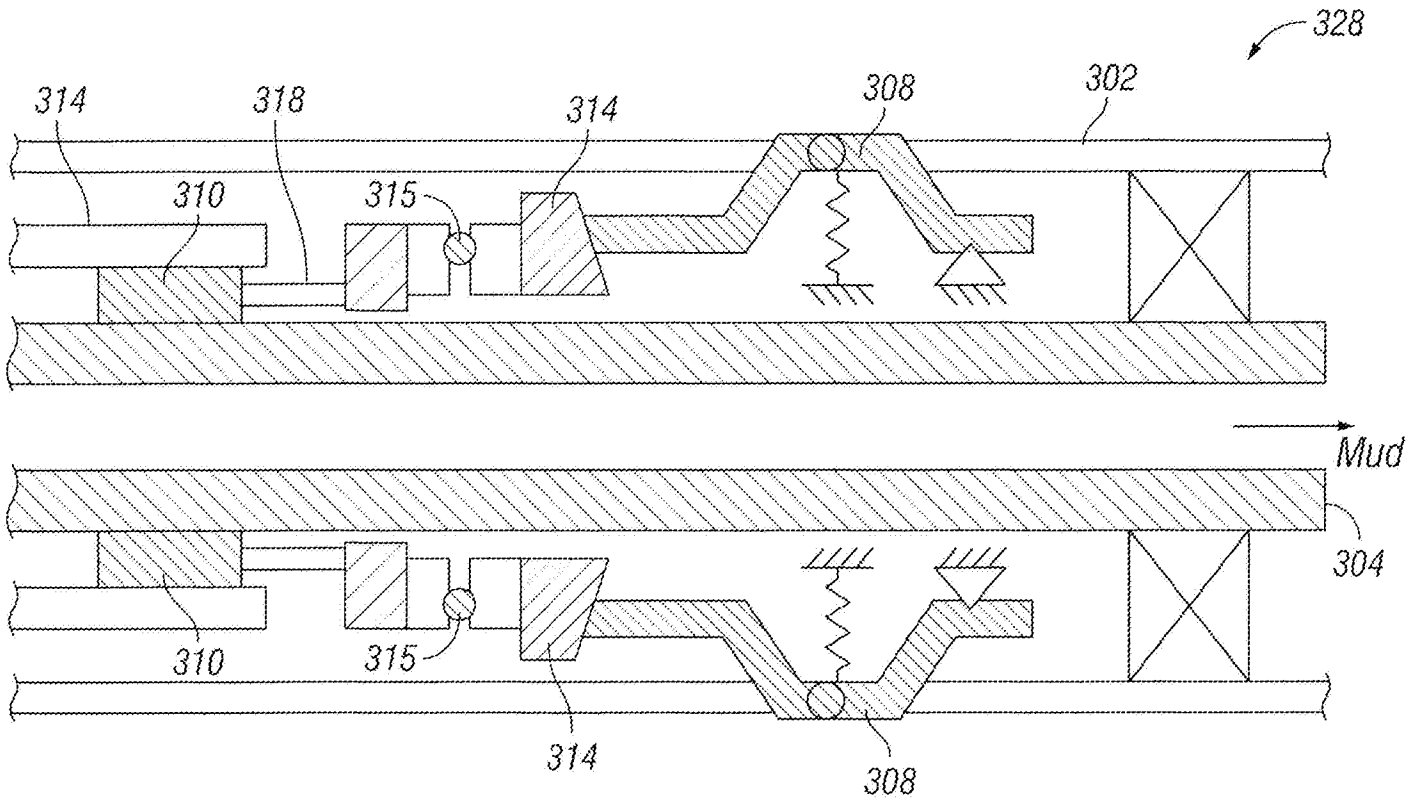
FIG. 3 depicts a cross-sectional schematic view of another rotary steerable tool, according to another example embodiment of rotary steerable tool.

FIG. 3 depicts a cross-sectional schematic view of a rotary steerable tool 328, according to another example embodiment. Similar to tool 228, the tool 328 includes an outer housing 302, a drive shaft 304, a piston device 310, piston arm 318, and one or more extendable members 308 spaced around and extendable outwardly from the outer housing 302. Optionally, the outer housing 202 may also include a non-extendable pad (not shown). The extendable members 308 are extendable via pressure to the piston device 310 from a hydraulics actuation system similar to that shown in FIG. 2. The extendable members 308 are coupled to springs 330 that retract the extendable members 308 upon release of pressure to the piston device 310. Further, the extendable members 308 may be coupled to the piston device 310 via a thrust bearing 315 and an axial cam 314. The axial cam or cams 314 interacts with the piston arm 318 and the extendable members 308 to control the amount of displacement of the extendable members 308 so that a given displacement of the piston arm 318 may radially extend each extendable member 308 a different amount, or selectively not displace a certain extendable member 308 at all. Thus, the plurality of extendable members 308 may be controlled together or separately. When the tool 328 is downhole, outwardly extending the extendable members 308 may initiate or increase the force applied onto the wellbore wall by the extendable members 308, and retracting the extendable members 308 may decrease or remove the force applied onto the wellbore wall by the extendable members 308. Further, the extendable members 308 may be coupled to the piston device 310 via a thrust bearing 315 that allows the extendable members 308 to rotate relative to the piston arm 318 and thus the drive shaft 304.

Figure 4A:
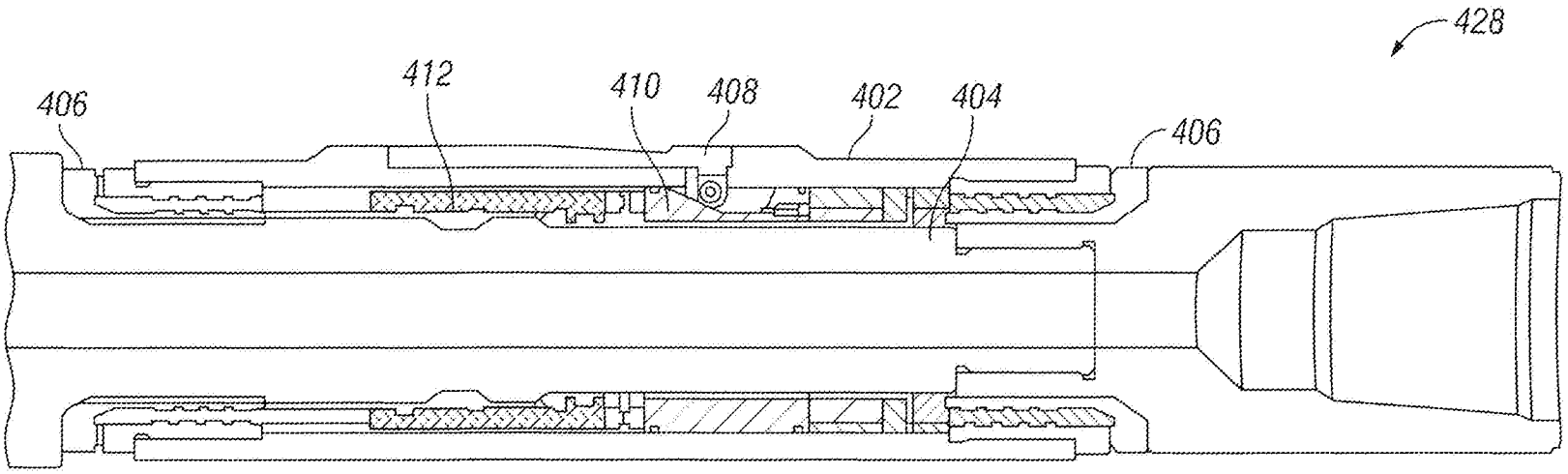
FIG. 4A depicts a cross-sectional view of a yet another rotary steerable tool, according to yet another example embodiment.
Figure 4B:
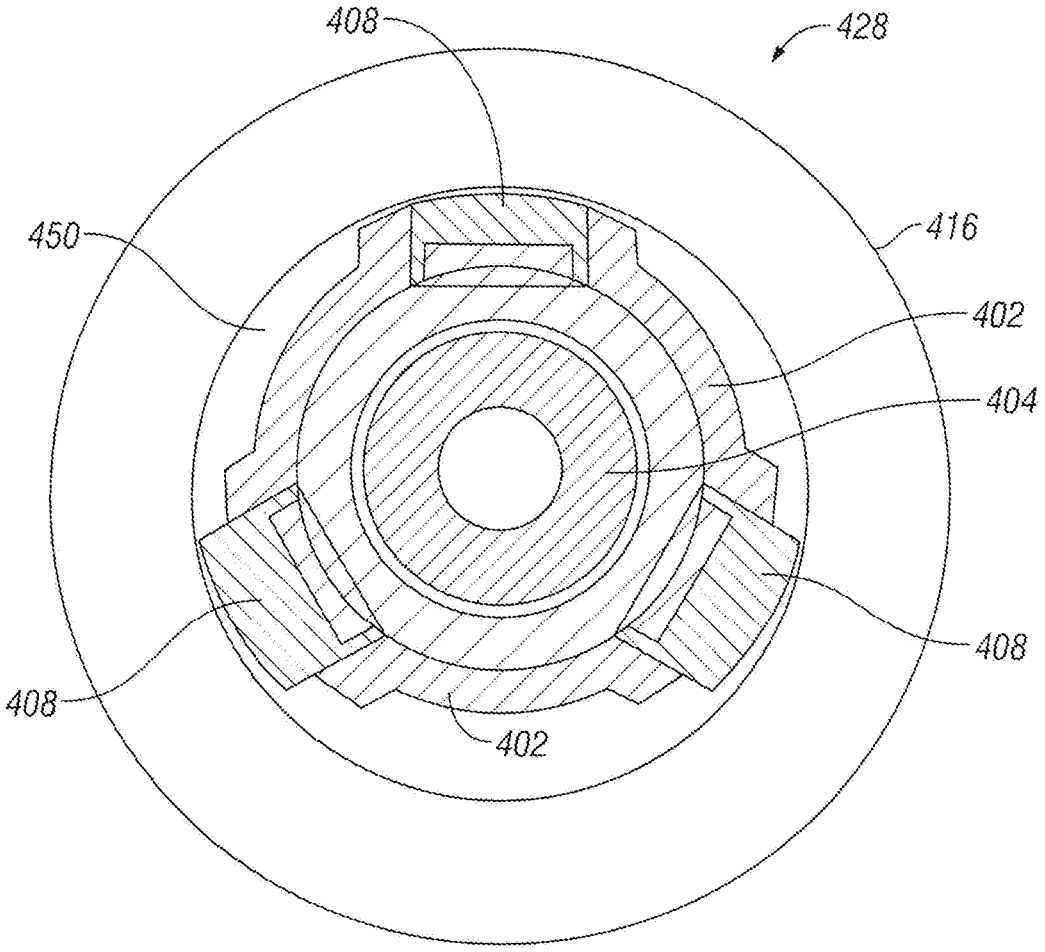
FIG. 4B depicts a radial cross-sectional view of the rotary steerable tool of FIG. 4A within a wellbore.

FIG. 4A depicts a cross-sectional view of a rotary steerable tool 428 and FIG. 4B depicts a radial cross-sectional schematic view of the rotary steerable tool 428 within a wellbore, according to one or more embodiments. The tool 428 includes an outer housing 402 and a driveshaft 404 rotatable with respect to the outer housing 402 via bearings 406. The tool 428 further includes one or more extendable members 408 and a cam 410 configured to push the extendable members 408 radially outward from the outer housing 402 when actuated. The cam 410 includes an incline plane that, when pushed forward, extends the extendable members 408 into an extended position. The cam 410 is pushed forward by a piston 412 pressurized by a hydraulic actuation system, similar to that shown in FIGS. 2 and 3.

As shown, not all of the extendable members 408 must be extended at the same time or to the same extent. With the extendable members 408 extended different amounts or not extended at all, the tool 428 is pushed off-center with respect to the wellbore 416. Also, a subset of the extendable members 408 may be extendable further than the remaining extendable member(s), such that when all the extendable members 408 are extended into contact with the wellbore 450, the tool 428 is pushed off center with respect to the wellbore 450. The rotational orientation and the radial position of the extendable members 408 thus determines the direction of well deviation. The rotational orientation of the extendable members 408 can be changed by retracting the extendable members 408 out of contact with the wellbore, which causes the outer housing 402 to rotate along with the driveshaft 404 due to a torque applied on the outer housing 404 by the driveshaft 404 via bearings, seals, or the like. When the desired position is reached, the extendable members 408 are again extended, contacting the wellbore 450, and holding the outer housing 402 stationary with respect to the wellbore 450. Thus, the well can be formed by controlling the rotational orientation as well as the radial extension of the extendable members 408 during drilling.

Figure 5:
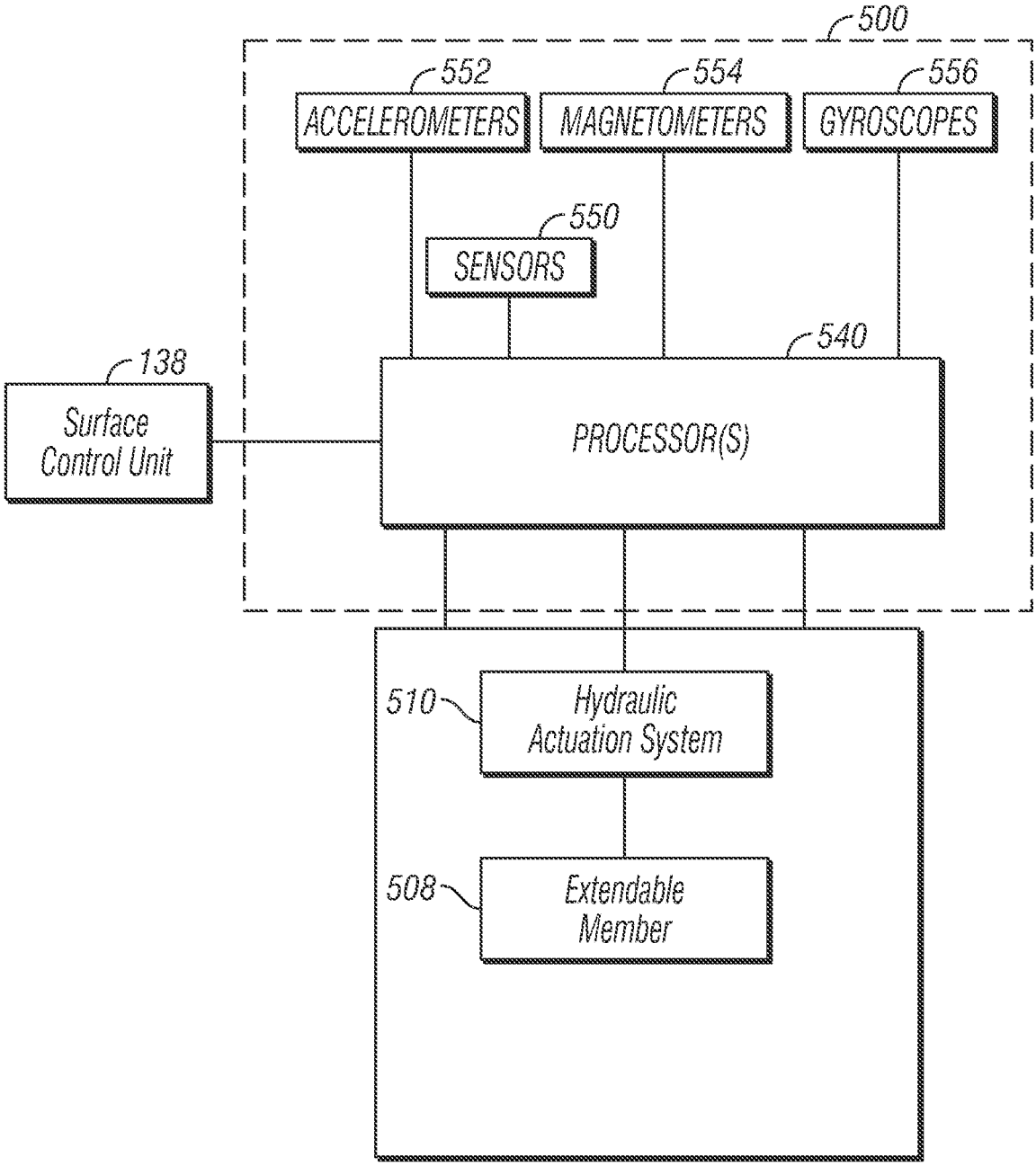
FIG. 5 depicts a block diagram of a control system of a rotary steerable tool, in accordance with one or more embodiments.

In any of the embodiments of the rotary steerable tool discussed above, the rotary steerable tool may include a control system with sensors and a processor configured to detect positional parameters of the tool and control extension of the extendable members based on a desired drilling direction and/or desired well profile. As an example, FIG. 5 depicts a block diagram of a control system 500, in accordance with one or more embodiments. The control system 500 may be located in outer housing, the driveshaft, or both. The control system 500 includes a processor 540 and a suite of sensors, including directional sensors such as accelerometers 552, magnetometers 554, and gyroscopes 556, and the like for determining a geological position and azimuth or toolface angle of the drill bit 114 to a reference direction (e.g., magnetic north), as well as the position and location of the outer housing. The control system 500 may include any number of these sensors and in any combination. Based on the azimuth and a desired drilling direction or drilling path, the rotary steerable tool determines a suitable control scheme to steer the tool string 126 and drill bit 114 in the desired direction, thereby creating the desired well. The control system 500 receives power from a power source, such as batteries, mud generators, among others. The power supply actually used in a specific application can be chosen based on performance requirements and available resources.

The control system 500 utilizes the sensors to maintain a geographic reference for steering control of the rotary steerable tool. The control system 500 may also include various other sensors 550 such as temperature sensors, magnetic field sensors, and rpm sensors, among others. The sensors are coupled to the processor 540. The sensors may be embedded anywhere on the rotary steerable tool and may take respective measurements and transmit the measurements to the processor 540 in real time.

The processor 540 is configured to control the hydraulic actuation system 510 which controls extension and retraction of the extendable member(s) 508. For example, in the embodiment of the rotary steerable tool 228 shown in FIG. 2, the processor 540 sends control signals to the motor 222 to drive the hydraulic pump 212. The profile of the drilling operation may include information such as the location of the drilling target, type of formation, and other parameters regarding the specific drilling operation. As the tool rotates, the sensors (e.g., accelerometers 552, magnetometers 554, and gyroscopes 556) send measurements to the processor 540. The processor 540 uses the measurements to track the position of the tool with respect to the target drilling direction, for example, in real time. The processor 540 may thus determine which direction to direct the drill bit 114 and when to extend and retract the extendable members. For example, when the extendable members 508 are retracted, the outer housing rotates with respect to the wellbore. When the outer housing rotates into the desired position, which is associated with the desired drilling direction, the extendable members are extended to hold the outer housing stationary with respect to the wellbore.

Since the location of the extendable members is fixed with respect to the outer housing, the location of the extendable members can be derived from the location of the outer housing. The processor 540 can then determine when to actuate the extendable members in order to direct the drill bit 114 in the desired direction. The extendable members can be actuated at any time interval for fully three dimensional control of the direction of the drill bit 114. The directional control may be relative to gravity toolface, magnetic toolface, or gyro toolface.

For example, if the drill bit 114 needs to be directed towards high side (0 degree toolface angle), then an extendable member is extended and made stationary against the wellbore wall at the 180 degree location of the tool. This pushes the drill bit 114 off center and the wellbore is drilled at the respective angle. When the drilling angle needs to be changed, the extendable member 508 is retracted and released from the wellbore.

The processor 540 may also be in communication with the surface control unit 138. The surface control unit 138 may thus send instructions or information to the processor 540 such as the information related to the profile of the drilling operation such as location of the drilling target, rate of direction change, and the like. For example, the surface control unit 138 may receive control commands from an operator which are relayed as processor-readable commands to control system 500. The surface control unit 138 may also send preprogrammed commands to the control system 500 set according to the profile of the drilling operation.

In addition to the embodiments described above, many examples of specific combinations are within the scope of the disclosure, some of which are detailed below:

Example 1. A directional drilling device for drilling a wellbore having a wall, comprising: an outer housing, a driveshaft located at least partially within and selectively rotatable with respect to the outer housing, extendable members moveable to extend radially outwardly from the outer housing and so as to apply a force onto the wellbore wall and move the device off-center in the wellbore in a direction, a hydraulic actuation system operable to control hydraulic fluid to extend and retract of the extendable members, wherein the rotational orientation of the extendable members is controllable by rotation of the outer housing by the driveshaft, and wherein the rotational orientation of the extendable members and the outer housing and thus the direction may be maintained by extension of the extendable members into contact with the borehole to restrain the outer housing from rotating.

Example 2. The device of example 1, wherein the extendable members are extendable in unison.

Example 3. The device of example 1, wherein the extendable member is extendable radially outwardly upon an increase in hydraulic pressure provided by the hydraulic actuation system.

Example 4. The device of example 3, wherein the hydraulic actuation system comprises a hydraulic pump and a piston device mechanically coupled to the extendable members and hydraulically coupled to the hydraulic pump so as to move the extendable member upon an increase or decrease in hydraulic pressure from the hydraulic pump.

Example 5. The device of example 4, wherein the piston device further comprises a chamber and a piston arm, wherein the chamber is hydraulically coupled with the hydraulic pump, and wherein the piston arm is mechanically coupled to the extendable members so as to move the extendable members upon a change in pressure in the chamber.

Example 6. The device of example 5, wherein the extendable members are retractable upon a decrease in pressure in the chamber.

Example 7. The device of example 5, further comprising a cam that interacts with the piston arm and the extendable members to control the amount of displacement of the extendable members so that a given displacement of the piston arm extends each extendable member a different amount or not at all.

Example 8. The device of example 1, further comprising a bearing rotatably supporting the driveshaft within the outer housing and that provides an amount of friction so as to apply a torque from the driveshaft to the outer housing during rotation of the driveshaft.

Example 9. The device of example 8, wherein the outer housing is rotatable by the driveshaft with the extendable members not contacting the wellbore wall.

Example 10. The device of example 1, wherein the housing comprises one or more sensors configured to determine one or more positional parameters of the housing and the extendable members.

Example 11. The device of example 1, further comprising a non-extendable pad protruding from the housing.

Example 12. The device of example 1, further comprising a control system comprising a processor in communication with the hydraulic actuation system to control extension of the extendable members.

Example 13. A directional drilling system for drilling a directional wellbore having a wellbore wall, comprising: an outer housing, a driveshaft located at least partially within the housing and rotatable with respect to the housing, a drill bit rotatable by the driveshaft, extendable members movable to extend radially outwardly from the housing so as to apply a force onto the wellbore wall at a first radial orientation, thereby pushing the drill bit laterally at a first toolface, wherein decreasing the force applied by the extendable members onto the wellbore wall permits the outer housing to rotate with the driveshaft and into a second radial orientation, a hydraulic actuation system configured to control the extension and retraction of the extendable members, and a control system comprising a processor and a sensor, the control system configured to monitor positional parameters of the housing and control extension and retraction of the extendable members via the hydraulic actuation system.

Example 14. The directional drilling system of example 13, wherein the control system comprises an accelerometer, a magnetometer, a gyroscope, or any combination thereof.

Example 15. The directional drilling system of example 13, wherein the hydraulic actuation system comprises a hydraulic motor and a pump controlled by the control system.

Example 16. The directional drilling system of example 13, wherein the control system is communicably coupled to a surface control center.

Example 17. The directional drilling system of example 13, wherein the housing is configured to rotate with the driveshaft upon retraction of the extendable member.

Example 18. A method of drilling a directional wellbore having a wall, comprising: rotating an outer housing of a drilling device to a first rotational orientation relative to the wellbore via rotation of a driveshaft, radially outwardly extending an extendable member from the outer housing into engagement with the wellbore wall, thereby restraining the outer housing from rotating with the driveshaft and pushing the drill bit off-center at a first toolface, and drilling the wellbore in the orientation of the first toolface to deviate the wellbore.

Example 19. The method of example 18, further comprising drilling a straight wellbore section.

Example 20. The method of example 18, further comprising applying a hydraulic pressure to a piston device, wherein the piston device is coupled to and controls extension of the one or more traction members using the hydraulic pressure.

Example 21. The method of example 18, further comprising: retracting the one or more traction members away from the wellbore wall, thereby allowing the outer housing to rotate with the driveshaft to a second rotational orientation.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A directional drilling device for drilling a wellbore having a wall, comprising:

an outer housing;

a driveshaft located at least partially within and selectively rotatable with respect to the outer housing;

extendable members moveable to extend radially outwardly from the outer housing and so as to apply a force onto the wellbore wall and move the device off-center in the wellbore in a direction;

a hydraulic actuation system operable to control hydraulic fluid to extend and retract the extendable members, the hydraulic actuation system comprising a hydraulic pump located in a portion of the driveshaft and a piston device mechanically coupled to the extendable members and hydraulically coupled to the hydraulic pump so as to move the extendable members upon an increase or decrease in hydraulic pressure from the hydraulic pump;

wherein the rotational orientation of the extendable members is controllable by rotation of the outer housing by the driveshaft; and wherein the rotational orientation of the extendable members and the outer housing and thus the direction may be maintained by extension of the extendable members into contact with the wellbore to restrain the outer housing from rotating.

2. The device of claim 1, wherein the extendable members are extendable in unison.

3. The device of claim 1, wherein each of the extendable members is extendable radially outwardly upon an increase in hydraulic pressure provided by the hydraulic actuation system.

4. The device of claim 3, wherein the piston device further comprises a chamber and a piston arm, wherein the chamber is hydraulically coupled with the hydraulic pump, and wherein the piston arm is mechanically coupled to the extendable members so as to move the extendable members upon a change in pressure in the chamber.

5. The device of claim 4, wherein the extendable members are retractable upon a decrease in pressure in the chamber.

6. The device of claim 4, further comprising a cam that interacts with the piston arm and the extendable members to control the amount of displacement of the extendable members so that a given displacement of the piston aim extends each extendable member a different amount or not at all.

7. The device of claim 1, further comprising a bearing rotatably supporting the driveshaft within the outer housing and that provides an amount of friction so as to apply a torque from the driveshaft to the outer housing during rotation of the driveshaft.

8. The device of claim 7, wherein the outer housing is rotatable by the driveshaft with the extendable members not contacting the wellbore wall.

9. The device of claim 1, wherein the housing comprises one or more sensors configured to determine one or more positional parameters of the housing and the extendable members.

10. The device of claim 1, further comprising a non-extendable pad protruding from the housing.

11. The device of claim 1, further comprising a control system comprising a processor in communication with the hydraulic actuation system to control extension of the extendable members.

12. A directional drilling system for drilling a directional wellbore having a wellbore wall, comprising:

an outer housing;

a driveshaft located at least partially within the housing and rotatable with respect to the housing;

a drill bit rotatable by the driveshaft;

extendable members movable to extend radially outwardly from the housing so as to apply a force onto the wellbore wall at a first radial orientation, thereby pushing the drill bit laterally at a first toolface, wherein decreasing the force applied by the extendable members onto the wellbore wall permits the outer housing to rotate with the driveshaft and into a second radial orientation;

a hydraulic actuation system configured to control the extension and retraction of the extendable members, the hydraulic actuation system comprising a hydraulic pump located in a portion of the driveshaft and a piston device mechanically coupled to the extendable members and hydraulically coupled to the hydraulic pump so as to move the extendable members upon an increase or decrease in hydraulic pressure from the hydraulic pump; and a control system comprising a processor and a sensor, the control system configured to monitor positional parameters of the housing and control extension and retraction of the extendable members via the hydraulic actuation system.

13. The directional drilling system of claim 12, wherein the control system comprises an accelerometer, a magnetometer, a gyroscope, or any combination thereof.

14. The directional drilling system of claim 12, wherein the hydraulic actuation system further comprises a hydraulic motor, and the motor and the pump are controlled by the control system.

15. The directional drilling system of claim 12, wherein the control system is communicably coupled to a surface control center.

16. The directional drilling system of claim 12, wherein the housing is configured to rotate with the driveshaft upon retraction of the extendable members.

17. A method of drilling a directional wellbore having a wall, comprising:

rotating an outer housing of a drilling device to a first rotational orientation relative to the wellbore via rotation of a driveshaft;

radially outwardly extending an extendable member from the outer housing into engagement with the wellbore wall via a hydraulic actuation system comprising a hydraulic pump located in a portion of the driveshaft and a piston device mechanically coupled to the extendable member and hydraulically coupled to the hydraulic pump, thereby restraining the outer housing from rotating with the driveshaft and pushing a drill bit off-center at a first toolface; and drilling the wellbore in the orientation of the first toolface to deviate the wellbore.

18. The method of claim 17, further comprising drilling a straight wellbore section.

19. The method of claim 17, further comprising applying a hydraulic pressure to the piston device.

20. The method of claim 17, further comprising retracting the extendable member away from the wellbore wall, thereby allowing the outer housing to rotate with the driveshaft to a second rotational orientation.

* * * * *